United States Patent [19]

Judd

[11] 4,202,426

[45] May 13, 1980

[54] EXHAUST GAS SPLITTER CONSTRUCTION

[76] Inventor: Fred V. H. Judd, 4876 Victor St., Jacksonville, Fla. 32207

[21] Appl. No.: 966,577

[22] Filed: Dec. 5, 1978

[51] Int. Cl.[2] ..... F01N 1/24

[52] U.S. Cl. ..... 181/257; 181/259; 181/268

[58] Field of Search ..... 181/212, 220, 224, 252, 181/256, 259, 260, 261, 262, 231, 264, 265, 268, 257

[56] References Cited

U.S. PATENT DOCUMENTS

| | | | |
|---|---|---|---|
| 3,215,172 | 11/1965 | Ardoin | 181/220 |
| 3,841,434 | 10/1974 | Culpepper, Jr. | 181/224 |

*Primary Examiner*—L. T. Hix

*Assistant Examiner*—Benjamin R. Fuller

[57] ABSTRACT

Splitter type exhaust silencers are improved by providing means for preventing dust particles from depositing upon sound deadening fibers exposed to the dust carrying exhaust gas stream by providing a dust-free boundary layer gas stream to flow protectively over the fiber and insulate the exhaust gas stream from the fiber. In alternate protective means, thin sheets or strips of strong material such as metal foil are mounted protectively near the exposed fiber which vibrate in the exhaust stream passing thereover and tend to continuously displace and/or prevent dust from settling upon the fiber. The thin sheets may be used alternately or together with the dust-free boundary layer gas stream to prevent dust deposition upon the fiber.

11 Claims, 6 Drawing Figures

Fig. 1
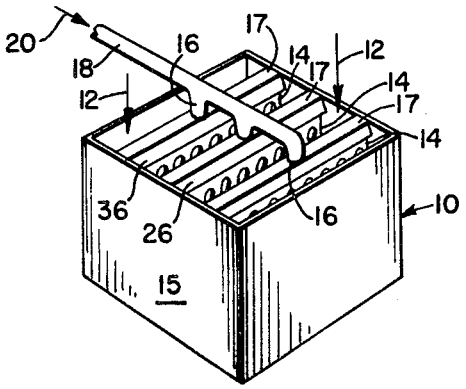
Fig. 2
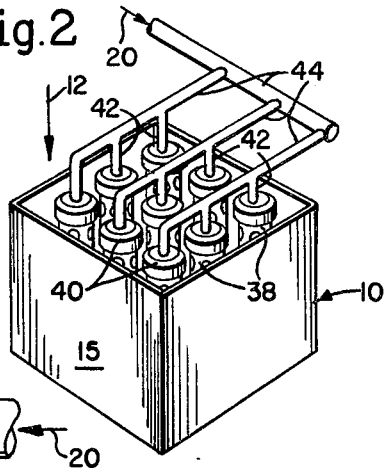
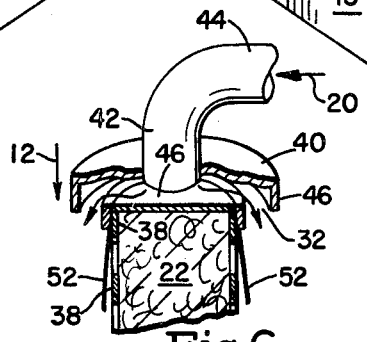
Fig. 6
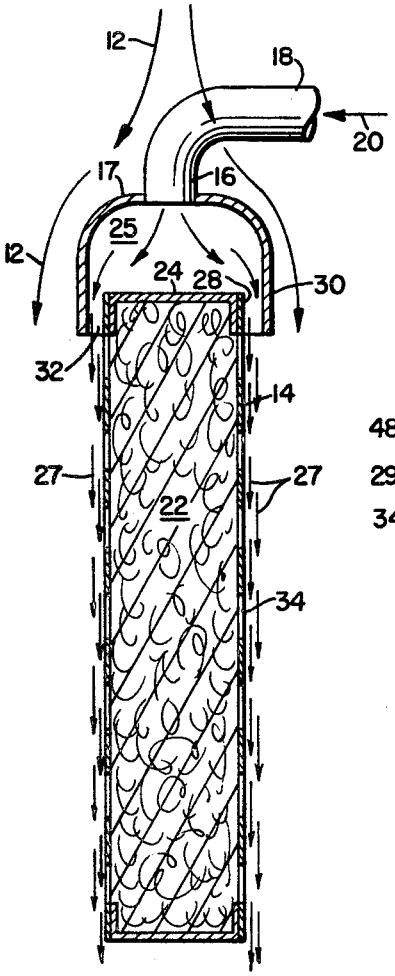
Fig. 3
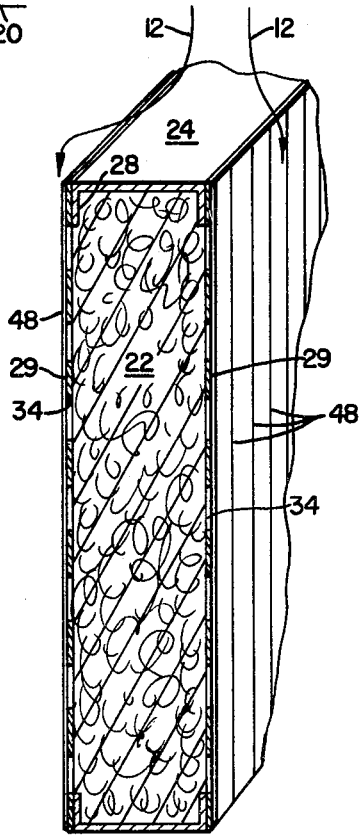
Fig. 4
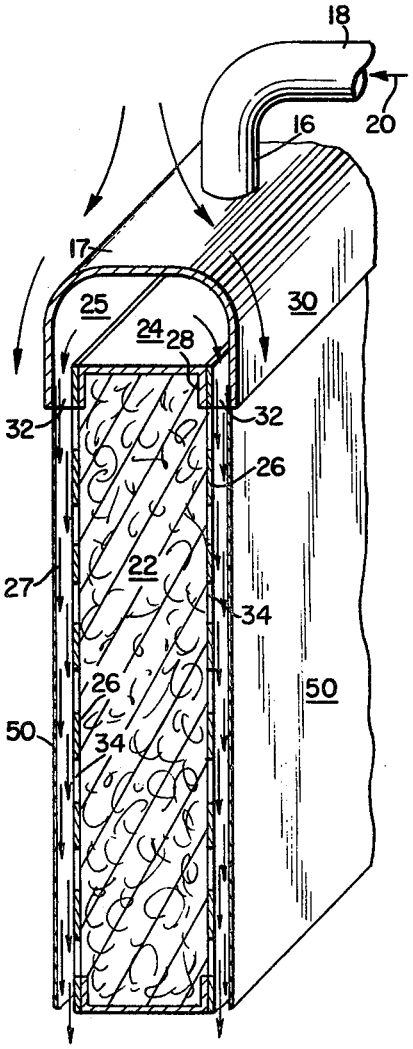
Fig. 5

EXHAUST GAS SPLITTER CONSTRUCTION

This invention relates to an improved splitter type silencer, including means for inhibiting the deposition of dust particles from depositing in or upon the fiberous packing conventionally supported in communication with the exhaust gas flow and tending to fill the sound absorbing interstices between the fibers with corresponding sound reducing efficiency.

In one aspect of the invention an independent stream of dust-free gas forming a boundary protective layer is flowed over the exposed surfaces of the fiberous packing or equivalent sound deadening medium used in the sound splitter in a position intermediate of the dust laden exhaust gases, whereby the independent boundary layer intercepts and displaces dust laden gases adjacent to the fiberous packing, displacing the same with a dynamically flowing boundary layer of dust-free air or other gas and thereby prevents deposition of dust in the fiber.

In a second aspect of this invention a layer of porous fiber or thin sheets in the form of porous or perforated sheets or strips are loosely supported adjacent to the sound deadening fiber so as to flutter in passage of the exhaust gas stream adjacent to the boundary gas layer adjacent to the fiber, and thereby agitates and stirs up any dust in boundary layer flowing thereby, and thus inhibits dust deposition in the sound deadening fiber.

Sound Splitters; are known in the art and are shown in my copending application Ser. No. 634,848 U.S. Pat. No. 4,105,089, as well as Ser. No. 872,746 patent pending, and consist of alternate structures in which exhaust gases are led to flow in separated streams adjacent to fiberous packings constrained by perforated walls which support the fiber exposed through the perforations as a filling, either with parallel walls along the sides of which the exhaust gas stream is split for flow in several parallel streams adjacent to the perforated walls; or, in alternate construction, the fibers are supported in perforated tubular bodies constraining the fiber to lie against the perforations in the annular walls with the exhaust streams split to flow around each tubular support adjacent to the exposed fiber. In both constructions, either the parallel walls or tubular supports, the fiberous packing is exposed to the noisy exhaust gas stream through perforations in the supporting walls thereof, whereby the exhaust gas flows along each perforated wall and has the noisy sound attending the rapid and sometimes explosive flow of the exhaust gas, dampened or muffled in contact with the fiberous body, silencing the flow to a comparatively noiseless passage of the rapidly moving gases in the exhaust stream. In either construction, exhaust gases carry dust particles suspended therein which tend to enter and clog the intertices between the sound deadening fibers and thereby tend to reduce the sound reducing capacity of the fiber.

According to the present invention, in a first aspect, the perforated walls, either perforated parallel walls with gas passageways therebetween, or tubular walls such as cylindrical walls, evenly disposed with gas passageways thereabout, have mounted near one end, an independent supply of clean dust-free gas supplied from a small plenum at one end of a wall or tube, constraining the clean gas to flow as a separate boundary layer supply over the fiber surfaces and positioned to be interposed between the fiber and the noisy exhaust gas stream, whereby the clean boundary layer gas is intermediately held free of dust, with the clean gas such as air forming a clean boundary air layer interposed between the fiber and the dust-carrying exhaust gas flow. This keeps dust disposed and suspended in the exhaust gas from depositing and clogging the interstices between the fiber, and thus to maintain the sound deadening effect at substantially peak efficiency.

In the alternate construction the perforated or porous sheet or fabric, either as a solid but thin and fine porous sheet or strips are supported from one end of the walls or tubes, to lie adjacent to the perforated surfaces boundary and supporting the sound deadening fiber. The sheets or strips are of thin enough texture to flutter in the exhaust gas stream, held in position to lie against the fiberous surface of the sound deadening packing, and the sheet or strip flutter tends to maintain the dust suspended in the exhaust gas stream to prevent the particles from settling in the intertices of the fiberous packing, whereby to maintain high sound deadening efficiency of the fiber packing.

For a third alternate, both of these protective means may be used in combination, that is, both a boundary layer stream of dust free air may be passed along the surface of the sound deadening packing, while the gas stream also induces fluttering in a thin sheet or strip layer disposed about the fiberous packing surfaces to flutter, both cooperating to prevent deposition of dust in the sound deadening fiber.

The invention is further described by way of the drawing, showing in several views the alternate constructions to illustrate these aspects of the invention wherein:

FIG. 1 shows a splitter type sound deadening device formed of parallel perforated walls;

FIG. 2 shows an alternate sound deadening device of perforated tubular bodies through which a fiberous packing in each perforated tube is exposed to the exhaust gas stream;

FIG. 3 shows a section through a perforated tube or wall, having a plenum chamber at one end through which a boundary layer stream of protective clean gas or air is flowed over a perforated wall surface;

FIG. 4 shows a perforated wall or tube having a thin sheet of loose strips or streamers supported for fluttering in the exhaust gas stream as they are supported adjacent to a perforated wall;

FIG. 5 shows the combined structures of FIGS. 3 and 4 having both a boundary layer stream of dust-free air flowed over perforated walls, and thin sheets (or streamers) supported from the same end of the wall or tube to flutter in the gas stream, cooperatively to prevent dust from depositing on the fiberous packing of the sound splitting wall or tube;

FIG. 6 shows a detail of the connection between a circular plenum and a tubular walled sound silencing element of FIG. 2.

A form of detailed structure both parallel wall or tubular of the sound splitter is shown in greater detail in my companion application referred to above, the disclosure thereof for further details of tube sound splitter constructions are here incorporated by reference.

Referring to FIGS. 1 and 2 the sound splitter has a housing or casing 10 of any suitable shape. It is here shown as having a rectangular shape, but it might be ovate, circular, or whatever is convenient. It is to connect in a manner not shown to ducting, in which high velocity exhaust gases flow from a direction indicated by the arrows 12.

FIG. 1 shows such sound splitter having a plurality of elongated parallel walls 14 extending from side to side 15 of the exhaust gas housing 10. The upper end, surmounting each wall 14 is a hollow plenum chamber 17. A duct 16 is fastened at one end to the plenum and the other end communicates with an inlet manifold 18 generally inter-connecting all plenums 17. The manifold 18 connects to a source of supply of fresh air or other dust free gas entering from a source not shown in the direction of the arrow 20. The plenums 17 of FIGS. 1, 3, 4 and 5 are elongated and each fit over the top of a wall 14 so that as a sound splitter each wall has its upper end closed by a top wall 24 and the entering exhaust gas splits to flow by each of the side walls which forms the bottom of the plenum chamber 25 in FIGS. 3 and 5. The plenum chamber 17 is frictionally fixed to the side walls 14 by an inner vertical flange 28. The outer plenum wall also forms an outer vertical flange 30 extending laterally of the wall 14 to form an opening 32 on each outer side of the wall 14 between the flanges 28 and 30. Air passed through the manifold 18 into the plenum chamber 25 passes out through the opening 32 and down along the side walls 14, as shown by the arrows 27 of the sound splitter wall 14.

Each sound splitter has two parallel side walls 14 which carry large perforations 34 evenly distributed over its entire wall surface so that the walls 14 of FIG. 1 are parallel and provide a mere encasing structure quite open by the numerous perforations 34. The perforated walls 14 encase and support a fiberous sound absorbing material 22, which is generally heat resistant, since exhaust gases passing thereby may be of high temperature. Such fiber, therefore, is usually glass wool, metal wool, rock wool, asbestos or the like. It is thus heat resistant, but of a porous fiberous material and is supported encased between the perforated walls 14, so that the fiber is exposed through the perforations 34. In prior construction such fiber is held in flowing contact with the hot exhaust gases passing thereby in the direction of the arrows 12 through the sound deadening device in split streams along each wall surface forming a sound absorbing silencer, muffler or the like. Thus, the perforated walls 14 are disposed as a series of parallel walls separated by passageways 36 between the walls 14 through which high velocity exhaust gases emitting sounds to be deadened or muffled are passed downward in the direction of arrows 12 through the chamber 10 and in surface contact with the fiberous filler 22, usually supported in contact with the exhaust gas through the perforations 34. In that prior construction the fiber tends to be filled with dust particles carried by the exhaust gas and loses its sound deadening efficiency. The deposition of dust in the fiber is prevented according to one phase of this invention by supplying a second gas stream 27 mounted to flow from outlets 32 over the perforated walls intermediate the fiber and exhaust gases to prevent dust deposition on the fiber.

In an alternate construction shown in FIG. 2, the entering exhaust gases in the direction of the arrow 12 and passing downward through the chamber 10 as in FIG. 1, are split to flow along the vertical side of numerous tubes 38 which have cylindrical walls and which are also perforated with holes 34. These cylinders 38 are also filled with heat resistant fiber as in FIG. 1 supported by the perforated walls 38 through which the sound absorbing fiber is exposed, so that the flowing exhaust gases usually passing downward over the perforated walls and in contact with the fibers exposed through the perforations similarly has its sound deadened as it passes in contact with the fibers exposed through the perforations in the cylindrical walls over which it flows according to prior constructions.

According to this invention, the cylindrical ends 40 have plenum caps fitted upon the vertical tubes 42 which join plenum caps at one end and a manifold 44 at the other. The manifold 44 is connected to a source of dust free gas, such as air or other gas, entering the manifold in the direction of the arrow 20 from a source of supply (not shown). The dust free gas passes through the manifold 44 into each small plenum at the top of each cylinder. The plenums 46 of FIG. 2 are circular, each to fit as a closure upon an annular wall 38 of the tubular elements of FIG. 2, in contrast to the elongated plenums 25 of FIG. 1.

Thus, as shown in detail in FIG. 6, the section through a perforated wall 38 of tubular construction will appear elongated as in FIGS. 3, 4 and 5, or merely diametric as shown in FIG. 6, as a section through a cylindrical tube 38 of FIG. 2. The plenum is an elongated chamber 17 to cover the fiber filled wall 14, or is a circular cap 40, according to the structure of FIG. 2.

Referring to FIG. 3, according to the first aspect of the invention, the gases supplied by the manifold 18 entering the elongated plenum 17 is supplied through the trough-like outlet 32 as a boundary layer stream, shown by the arrows 27 and forms a protective layer of clean air or other dust free gas flowing against the fiber packing. An outer layer of exhaust gas shown by the arrows 12 also pass through the sound deadening device and normally in other prior art construction would pass in a stream 12 along the perforated walls 14.

According to the present construction, an intermediate layer of clean air 27 is established as a stream shown by the arrows and which passes along the fiber of the wall 14 exposed to the perforations 34 and prevent the dust-bearing exhaust gases from contacting the fiber filling the wall 14. It thus prevents the dust in the exhaust stream 12 from contacting and depositing dust in the fiber 22. In this manner the fiber is maintained in a state of comparatively high sound absorbing efficiency by being protected by the intermediate layer 27 of clean gas emitted from the openings 32.

In an alternate construction shown in FIG. 4, the perforated walls 26 are covered by a thin sheet 48 of woven fiber or highly porous sheet material, which lies against the perforations 34 through which the fiber 22 is exposed. The sheet material will vibrate and flutter in the exhaust gas stream and thus tends to protect fiber from deposition of dust from the exhaust gas stream flowing thereby, as shown by the arrows 12. The fiberous sheet shown here somewhat exaggeratedly thick is thin enough to vibrate the flutter in the gas stream, and that fluttering-vibrating movement in contact with the fiber packing 22 exposed through wall perforations 34 will tend to prevent deposition of dust in the fiber packing, and thus maintain the sound deadening efficiency thereof.

The sheet material is thin enough to be affected by the gas stream flowing thereby as to vibrate and flutter as it flows. It should also be heat resistant and preferably is a porous, loose woven fiber or perforated sheet, so that the gas will flow evenly on the entire side of the sheet with minor exchange. Consequently, such materials as metal foil, heat resistant fiber, such as glass wool in woven or matted sheet form, or asbestos whichmay be perforated, and other heat resistant materials having such properties. As noted below, the sheets may be cut into streamers which flutter in the gas stream but which may be otherwise of the same or similar material substance and characteristics.

In a modified form, the sheet 48 shown in detail in FIG. 6 may be substituted by streamers or strips of flexible sheet 52 which similarly flutter toward and away from the exposed fiber through the perforations 34, and similarly prevent deposition of dust. Such sheets or strips are suspended from an annular flange 28 disposed about the upper end of a wall 14 or 38 for support of such sheets.

In a third alternative structure shown in FIG. 5, the fiber sheet or strips is shown for use in a combination with a protective boundary layer stream of clean air or gas emitted from a plenum 25, as in FIG. 3 through openings 32, whereby the fiber 22 exposed through perforations 34 is maintained free of dust deposition by the combined effects of the clean boundary layer of air emitted from openings 32 flowing thereover, and the flexible sheets or strips fluttering in the exhaust gas stream, both in combination operating to prevent the dust deposition in the exhaust gas from depositing upon the exposed sound deadening fiber exposed streams, in which both the clean boundary air layer and the vibrating sheet or strip are supported intermediate the outer dust laden exhaust gas stream.

Various modifications of sound deadening devices in which an intermediate boundary layer of dust-free air or sheet like vibrating means are used to prevent dust laden exhaust gases from depositing dust in sound deadening fiber used therewith, will occur to those skilled in the art, and correspondingly, it is intended that the description given here be regarded as exemplary and not limiting, except as defined in the claims.

I claim:

1. In a sound absorbing device for noisy exhaust gas flow having dust particles suspended therein, and having sound absorbing fiber mounted exposed to said exhaust gas flow for large area surface contact of said fiber with the exhaust gas flow, the improvement comprising means for flowing relatively dust-free gas as a boundary layer of said gas adjacent to said exposed fiber surfaces inhibiting dust deposition from said exhaust gas upon and between the fibers to maintain the sound absorbing efficiency of said fiber.

2. The sound absorbing device as defined in claim 1 wherein the means for inhibiting dust deposition further includes means for flowing dust-free gas as a boundary layer over said sound absorbing fiber as a protective dust-free gas layer intermediate the flowing stream of said exhaust gas and said sound absorbing fiber.

3. The sound absorbing device as defined in claim 1 wherein said means for flowing a relatively dust-free gas layer over said sound absorbing fiber includes a plenum chamber having means for passing air therein and having an outlet nozzle, said nozzle being shaped to emit a flowing layer of dust-free air over the exposed surface of said sound absorbing fiber in the same direction as said exhaust gas flow and means for supplying said dust-free air under flowing pressure to said plenum.

4. The sound absorbing device as defined in claim 1, wherein the exhaust gas is split to flow along several separated parallel walls over which the noisy exhaust gas normally flows, said walls being perforated and having the sound absorbing fiber exposed through said perforations to said gas flow and said means for inhibiting dust deposition is an independent layer of dust-free gas evolved from a plenum chamber mounted upon an end of each wall with the dust-free gas emitted to flow parallel and as a boundary layer stream flowing intermediate to said exposed fiber surfaces supported in said walls and the noisy exhaust gas flow between walls.

5. The sound absorbing device as defined in claim 1, wherein the exhaust gas stream is split to flow among and over the surfaces of several perforated tubular wall containers through which the sound absorbing fiber is supported and exposed to the noisy exhaust gas stream flowing thereby, and each tubular wall having an annular plenum chamber mounted upon an end with the dust-free gas emitted from an annular nozzle outlet for each plenum, shaped to flow the dust-free gas over the tubular perforated walls and sound absorbing fiber exposed therefrom as a boundary layer intermediate and parallel to said noisy gas flowing between said tubular containers.

6. The sound absorbing device as defined in claim 5 wherein the exhaust gas stream is split to flow among and over the surfaces of several perforated tubular wall containers through which the sound absorbing fiber is supported and exposed to the noisy exhaust gas and the means for inhibiting dust deposition is flexible thin sheet or strips supported above and extending adjacent to the exposed surfaces of said sound absorbing fiberous packing to substantially cover said exposed fiberous surfaces thereof, and tending to flutter and vibrate in passage of said noisy dust carrying exhaust gas stream over said exposed sound absorbing fiberous surfaces, inhibiting dust deposition in the intertices of said fiber.

7. The sound absorbing device as defined in claim 4 wherein the exhaust gas is split to flow among several separated parallel dividing walls over which the noisy exhaust gas normally flows, said walls being perforated with the fiber disposed and supported between pairs of perforated walls with the sound absorbing fiber exposed to the exhaust gas flow through said perforations, and said means for inhibiting dust deposition in the fiber is both an independent boundary layer stream of dust-free gas evolved from an elongated plenum chamber mounted upon each wall from side to side, with the dust-free gas emitted from said plenum to flow as a boundary layer stream flowing intermediate and parallel to said exposed fiber surfaces supported in said wall and the noisy exhaust gas flowing between the walls, and a second dust inhibitive means comprising a flexible thin sheet or strips supported above said wall of sound absorbing fiberous packing and disposed intermediate between said dust-free boundary layer of gas flowing adjacent to said fiberous layer and said noisy exhaust gas stream.

8. The sound absorbing device as defined in claim 5 wherein the exhaust gas is split to flow between and over the surfaces of several perforated tubular wall containers in which the sound absorbing fiber is supported and exposed to the gas stream flowing thereby, each tubular wall having an annular plenum chamber mounted upon one end thereof with the dust-free gas emitted from an annular nozzle outlet for each plenum, shaped to flow the dust-free gas over the tubular perforated walls, the sound absorbing fiber exposed through said perforations having a boundary layer of dust-free gas flowing intermediate and parallel to said noisy gas flow between said tubular containers, and tending to inhibit dust deposition in and upon said fiber, and further means for inhibiting dust deposition comprising a thin sheet or strips supported above and extending parallel to the exposed surfaces of said sound absorbing fiberous packing to substantially cover said fiberous surfaces, said sheet or strips being supported between the parallel flowing gas streams, the dust-free gas stream between said sheet or strips and said exposed fiber surfaces and the outer noisy exhaust gas stream, both the dust-free stream and vibrating sheet or strips in combination inhibiting dust deposition in the intertices of said fiber.

9. In a sound absorbing device for noisy exhaust gas flow having dust particles suspended therein, and having sound absorbing fiber mounted exposed to said exhaust gas flow for large area surface contact of said fiber with the exhaust gas flow, the improvement comprising flexible thin sheets or strips mounted adjacent to said sound absorbing fiber and vibratable by flutter in the boundary layer gas flow thereover, the vibration and flutter agitating said boundary layer gas to inhibit dust deposition upon said exposed fiber.

10. The sound absorbing device as defined in claim 9, wherein the exhaust gas is split to flow among several separated parallel dividing walls over which the noisy exhaust gas normally flows, said walls being perforated with the fiber disposed and supported between pairs of perforated walls with the sound absorbing fiber exposed to the exhaust gas flow through said perforations, and said means for inhibiting dust deposition in the fiber is both an independent boundary layer stream of dust-free gas evolved from an elongated plenum chamber mounted upon each wall from side to side, with the dust-free gas emitted from said plenum to flow as a boundary layer stream flowing intermediate and parallel to gas flowing between the walls, and a second dust inhibitive means comprising a flexible thin sheet or strips supported above said wall of sound absorbing fiberous packing and disposed intermediate between said dust-free boundary layer of gas flowing adjacent to said fiberous layer and said noisy exhaust gas stream.

11. The sound absorbing device as defined in claim 9, wherein the exhaust gas is split to flow between and over the surfaces of several perforated tubular wall containers in which the sound absorbing fiber is supported and exposed to the gas stream flowing thereby, each tubular wall having an annular plenum chamber mounted upon one end thereof with the dust-free gas emitted from an annular nozzle outlet for each plenum, shaped to flow the dust-free gas over the tubular perforated walls, the sound absorbing fiber exposed through said perforations having a boundary layer of dust-free gas flowing intermediate and parallel to said noisy gas flow between said tubular containers, and tending to inhibit dust deposition comprising a thin sheet or strips supported above and extending parallel to the exposed surfaces of said sound absorbing fiberous packing to substantially cover said fiberous surfaces, said sheet or strips being supported between the parallel flowing gas streams, the dust-free gas stream between said sheet or strips and said exposed fiber surfaces and the outer noisy exhaust gas stream, both the dust-free stream and vibrating sheet or strips in combination inhibiting dust deposition in the intertices of said fiber.

* * * * *